US005505867A

United States Patent [19]

Ritter

[11] Patent Number: 5,505,867

[45] Date of Patent: Apr. 9, 1996

[54] FUEL AND LUBRICATION OIL ADDITIVE

[76] Inventor: Clyde G. Ritter, 765 Clark St. S., Vale, Oreg. 97918

[21] Appl. No.: 271,121

[22] Filed: Jul. 6, 1994

[51] Int. Cl.[6] ..... C10M 101/04; C10M 135/10

[52] U.S. Cl. ..... 252/18; 252/25; 252/33; 252/39

[58] Field of Search ..... 252/18, 25, 33, 252/33.4, 39; 44/308, 373; C10M 101/04, 135/10

[56] References Cited

U.S. PATENT DOCUMENTS

| | | | |
|---|---|---|---|
| 2,585,520 | 2/1952 | Ess et al. | 252/33 |
| 4,129,589 | 12/1978 | Eliades et al. | 260/504 A |
| 4,279,837 | 7/1981 | Wellbrook | 260/505 N |
| 4,306,983 | 12/1981 | Allain et al. | 252/33.3 |
| 4,347,147 | 8/1982 | Allain et al. | 252/33.3 |
| 4,557,841 | 12/1985 | Arbdt | 252/32.7 E |
| 4,597,880 | 7/1986 | Eliades | 252/33.4 |
| 4,617,135 | 10/1986 | Muir | 252/33.2 |
| 4,647,387 | 3/1987 | Muir | 252/25 |
| 4,664,821 | 5/1987 | Arndt | 252/32.7 E |
| 4,668,413 | 5/1987 | Johnston et al. | 252/56 R |
| 5,137,980 | 8/1992 | Degonia et al. | 525/327.6 |
| 5,259,966 | 11/1993 | Burke, Jr. et al. | 252/18 |

OTHER PUBLICATIONS

"Alternatives for Chlorinated Paraffins in Drawing and Soluble Oils", Witco Corp. brochure, Apr. 25, 1994.

"Lubrication and Lubricants" and Sulfonation and Sulfonation both in Kirk–Othmer Encyclopedia of Chemical Technology, John Wiley and Sons, New York, 1979, Third Edition, vol. 14 p. 494, and vol. 22, p. 23.

MSDS sheets for C400–C and RDS015, Witco Corp. No date.

*Primary Examiner*—Prince Willis. Jr

*Assistant Examiner*—Cephia D. Toomer

*Attorney, Agent, or Firm*—Ken J. Petersen; Barbara S. Pedersen

[57] ABSTRACT

Embodiments are described of an additive composition of matter, for inclusion in fuels and in lubricants, which comprises an overbased sulfonate, jojoba oil, and castor oil. Adding the additive to transportation fuels, such as diesel fuel or automobile gasoline, greatly improves combustion engine performance and mileage. Adding the additive to motor-oil or other lube oils greatly improves the lubrication performance of the oil. There is a synergy between the overbased sulfonate, jojoba oil, and castor oil that provides remarkable performance improvements especially under high pressure and high temperature conditions, and also provides residual protection for an engine or other machinery that improves re-start and subsequent operation. The additive also provides excellent lubrication for non-ferrous metals, and is less toxic than those additives containing chlorinated compounds.

11 Claims, No Drawings

FUEL AND LUBRICATION OIL ADDITIVE

BACKGROUND OF THE INVENTION

1. Field of the Invention

This invention relates generally to additives for engine fuels and lubricating oils. More specifically, this invention relates to combustion-optimizing additives for engine fuels and to anti-friction additives for lube oils that are less toxic than conventional additives.

2. Related Art

Overbased sulfonates are metallic salts of sulfonic acid compounds and are well known in the art. Overbased sulfonates are "characterized by a metal content in excess of that which would be present according to the stoichiometry of the metal and the acidic organic compound reacted with the metal". (Burke. Jr. et al. U.S. Pat. No. 5,259,966.) The "overbased" metal content of an overbased sulfonate typically may be suspended or complexed with the petroleum sulfonate. (*Kirk-Othmer Encyclopedia of Chemical Technology*, John Wiley & Sons, Third Edition, N.Y. (1979), vol. 22, page 23).

The most widely-used overbased alkaline-earth sulfonates are based on calcium, magnesium, and barium. (*Kirk-Othmer*, supra., vol 22, page 23). Overbased calcium sulfonates, for example, might include CaO, $Ca(OH)_2$, or $CacO_3$ suspended or complexed with the sulfonate. For example, the formula for an overbased calcium petroleum sulfonate named C400-C™ manufactured by Surpass Chemicals Limited, West Hill, Ontario, Canada, is reported to be: $(RC_6H_4SO_3)_2Ca+CaCO_3$.

Methods of manufacturing overbased sulfonates are described in various patents, including: Eliades et al., U.S. Pat. No. 4,129,589; Allain et al., U.S. Pat. No. 4,306,983; Allain et al., U.S. Pat. No. 4,347,147; Eliades et al., U.S. Pat. No. 4,597,880; Muir, U.S. Pat. No. 4,617,135; and Burke, Jr. et al., 5,259,966.

The extent to which an overbased sulfonate is "overbased", or "superbased" as described by some references, is described by: a) the metal ratio of equivalents of metal to equivalents of sulfonic acid, and/or b) by a measure of alkalinity (alkalinity value or titratrable base number). Titratable base number (TBN) is determined by titration and is equivalent to the milligrams KOH per gram of sample. (*Kirk-Othmer*, supra., vol. 22, page 23). Eliades et al. '589 discloses a method for producing an over-based oil-soluble magnesium salt of a sulfonic acid that exhibits metal ratios of up to 40 or more. Muir discloses a method for producing overbased magnesium sulfonates of exceptionally high alkalinity of up to 500 TBN or more.

Overbased sulfonates have been used in the past in lubricant fluids such as motor-oil additives and greases because of their excellent detergent and dispersing properties and their ability to neutralize engine acids. (*Kirk-Othmer*, supra., vol. 22, page 23, and vol. 14, page 494). Eliades et al. '589 discusses overbased, oil-soluble magnesium salts of sulfonic acids as lube oil additives that "function as detergents and acid neutralizers, thereby reducing wear and corrosion and extending the engine life."

An example of the use of overbased sulfonates in motor oil is disclosed by Arndt (U.S. Pat. Nos. 4,557,841 and 4,664,821). Arndt discloses a crankcase motor oil additive concentrate for addition to used engine oil to supplement and enhance the additive system already present in the used oil. Arndt's concentrate comprises 1) a petroleum base stock suitable for crankcase motor oils, 2) detergent-inhibitor package, 3) supplemental anti-wear additive from salts of dialkyl dithiophosphoric acid, 4) supplemental anti-wear additive from the class of sulfurized olefins, 5) corrosion inhibitor from the class of overbased sulfonates, the sodium salt being preferred, and 6) a lubricity additive known familiarly as jojoba oil. Arndt claims percentages of overbased sulfonate and jojoba oil in the concentrate of 1–5 wt-% and 0.1–10 wt-%, respectively, and percentages of the concentrate in the crankcase oil of 5–15 wt %.

Early overbased sulfonates, of the type used for engine crankcase oil, were sometimes added to straight oils for metalworking applications such as drawing and stamping. However, this use of the early overbased sulfonates was somewhat limited due to the need for development of overbased sulfonates with improved metalworking oil properties, including: better anti-corrosion properties, improved solubility in paraffinic base oils, lower viscosity for easier handling, better clarity when using the crystalline form of overbased sulfonates, reduced instability due to reactivity with other additives, and consistent lubricity in finished formulations. ("Alternatives for Chlorinated Paraffins in Drawing and Soluble Oils," Witco Corporation marketing brochure, April 1994).

Over the last few years, the use of overbased sulfonates in metalworking lubrication applications has become more common. This increased metalworking use results from improved overbased sulfonate formulations and because of interest in removing chlorinated paraffins from cutting and other metal-working oils because of environmental concerns about hydrogen chloride and hydrochloric acid.

New overbased sulfonate formulations have recently been developed in an attempt to broaden the applications of overbased sulfonates in metalworking. These formulations claim improved anti-corrosion properties and lessened reactivity with other additives, and therefore are valuable in many metalworking applications, such as press oils and prelubes. (Witco, supra.)

Overbased sulfonates for metalworking applications have been formulated from natural-based organic compounds, natural-synthetic-blend compounds, or synthetic-based compounds. Either natural or natural-synthetic blends are usually preferred because of the benefits of broad molecular weight distribution in most sulfonate applications. (Witco, supra.)

Overbased sulfonates used in engine oil and for metalworking have typically included alkaline-earth metals that are in amorphous form, which, in some cases, has limited their applications. For example, amorphous overbased calcium sulfonates have usually been used in metalworking as straight oils, without being emulsified in water, because contact with water thickens the sulfonate when the calcium amorphous form converts to the calcium crystalline form. Crystalline forms of overbased calcium sulfonate have recently been developed, in which the calcium is converted to the crystalline form in a controlled fashion during manufacture. (Witco, supra.) These crystalline overbased calcium sulfonates are recommended for metalworking applications where soluble-oil emulsions are needed, because they do not thicken with contact with water.

SUMMARY OF THE INVENTION

The instant invention comprises an additive composition-of-matter for inclusion in fuels and in lubricants. The additive composition comprises an overbased sulfonate, jojoba oil, and castor oil. Adding the additive to combustion engine fuels, such as diesel fuel or automotive gasoline, greatly improves engine performance and mileage. Adding the additive to motor-oil or other lube oils greatly improves the lubrication performance of the oils.

The remarkable improvements in the combustion performance of fuels and the lubrication performance of lube oils caused by the additive are a surprising result of combining the three additive components. There is a synergy between the overbased sulfonate, jojoba oil, and castor oil that provides these remarkable performance improvements, especially under high pressure and high temperature conditions. The combination of overbased sulfonate, jojoba oil, and castor oil also provides residual protection for an engine or other machinery that improves re-start and subsequent operation. The additive also provides excellent lubrication for non-ferrous metals, whereas most commercial lube oils and additives offer little or no lubrication for non-ferrous metals. Also, the invented additive is less toxic than many additives, for example, those containing chlorinated compounds.

DETAILED DESCRIPTION OF THE PREFERRED EMBODIMENTS

The invented additive composition of matter comprises an overbased sulfonate, jojoba oil, and castor oil. The term "overbased sulfonate" is meant to include any metallic salt of sulfonic acid compound(s) having "a metal content in excess of that which would be present according to the stoichiometry of the metal and the acidic organic compound reacted with the metal", including compounds designated as "superbased sulfonates", "overbased petroleum sulfonates", "overbased alkaline-earth sulfonates", and "natural-based", "synthetic-based", or "natural-synthetic blend" overbased sulfonates, etc..

In this description, the terms "treated fuel", "treated lube oil", or "treated motor-oil" mean that the fuel, lube oil, or motor-oil, respectively, includes a dose of the invented additive in an effective amount. Likewise, the terms "untreated fuel", "untreated motor-oil", etc., refer to fuel and motor-oil, etc. that have not been treated with the invented additive.

In the invented additive, the overbased sulfonate is believed to be an anti-weld, anti-corrosion, and detergent agent; the jojoba oil is believed to be a suspension agent; and the castor oil is believed to be a lubricity agent. Beyond these individual effects, however, when the three components are combined into the additive, there is a surprising synergy or combined effect that makes the additive a remarkable combustion-optimizer and lubrication-enhancer.

A Timken™ bearing apparatus was used to conduct various tests, herein called Timken™ Extreme Pressure Comparison Tests (Timken™ EP tests), to measure the lubrication effect of the invented additive relative to other additives and lubricants. The Timken™ apparatus includes a bearing running against a sacrifice bearing and a means of applying varying amounts of pressure to press the sacrifice bearing against the bearing. In a method hereafter called "surface application", the bearing and sacrifice bearing may be coated, either manually or by a drip tray, with the liquid that is to be tested for lubrication performance. Alternatively, in a method hereafter called "emersion", the bearing may be run in a reservoir filled with the liquid that is to be tested for lubrication performance. The bearing and sacrifice bearing may be replaced, for starting with fresh metal or for trying various metals. In this Timken™ EP test, lubrication performance is measured by the relative time the bearing and sacrifice bearing can run at a particular pressure with the particular liquid, without seizing up, smoking, being destroyed, or otherwise failing.

The Timken™ EP test showed that the invented additive produces superior lubrication performance both in a fuel and in a motor-oil, and also that all three components of the additive (the overbased sulfonate, jojoba oil, and castor oil) are required for this superior performance. Treated fuel and treated motor-oil were compared in the Timken™ EP test to untreated fuel and untreated motor-oil. Also, treated fuel and treated motor-oil were compared to fuel and motor-oil containing an incomplete additive, for example: a) overbased sulfonate only, b) overbased sulfonate plus jojoba only, or c) overbased sulfonate plus castor oil only. The tests involving fuel were done using the emersion method and the tests involving motor-oil were done using the surface application method. Of all these tested options, only two formulations produced superior performance: 1) fuel with an additive of overbased sulfonate, jojoba oil, and castor oil and 2) motor-oil with an additive of overbased sulfonate, jojoba oil, and castor oil. Thus, all three components are required in the invented additive. Adding overbased sulfonate by itself to either fuel or motor-oil, as in a) above, produced little or no improvement in lubrication performance of the fuel or motor-oil.

Attempts were made to find substitutes for the jojoba oil and/or the castor oil. Formulations containing other natural and synthetic oils in the place of jojoba oil and/or castor oil were tested in the Timken™ apparatus. Many oils were tried, including Mobil 1™ motor-oil, Castrol™ motor-oil, natural oil of wintergreen, straight mineral oil, and neutral oil, but none of the oils were adequate substitutes for either the jojoba oil or the castor oil.

The preferred proportions of overbased sulfonate, jojoba oil, and castor oil in the additive are 40 vol-%/10 vol -%/50 vol-%, respectively. However, the invention is not limited to these preferred proportions. For example, the overbased sulfonate contents ranging from about 20 vol-% up to about 50 vol-% have been tested and work well. Jojoba oil contents ranging from about 20 vol-% down to about 1 vol-% have been tested and work well, except that, at the lower end of this range, the low concentration of jojoba oil causes an inferior suspension or blend of the three components. In an additive consisting of the three components of overbased sulfonate, jojoba oil, and castor oil, therefore, the castor oil content may be calculated by difference to be in a range 79 vol-% - 30 vol-%. In other words, when the overbased sulfonate and jojoba oil are both at the low end of the ranges of their concentrations, that is, 20 vol-% and 1 vol-%, respectively, the castor oil is 79 vol-% of the additive. When the overbased sulfonate and jojoba oil are both at the high end of the ranges of their concentrations, that is, 50 vol-% and 20 vol-%, respectively, the castor oil is 30 vol-% of the additive.

The preferred technique for blending the additive is as follows: a) mix part of the jojoba oil with the overbased sulfonate, b) in a separate container, mix the remaining jojoba oil with the castor oil at an elevated temperature of about 100°–140° F., and then c) mix together the resulting blends from a) and b) above to form the additive. This technique results in better suspension of the castor oil in the overbased sulfonate.

Fuel Additive

The formulation of the invented additive for transportation and stationary engine fuels, hereafter called "fuel additive", preferably comprises a blend of C400-C™ Overbased Sulfonate/jojoba oil/castor oil, in approximate proportions of 40 vol-%/10 vol-%/50 vol-%, respectively. The C400-C™ Overbased Sulfonate is manufactured by Surpass Chemicals Limited, 10 Chemical Court, West Hill, Ontario, Canada, M1E 3X7 and marketed by Witco Corporation, One American Lane, Greenwich, Conn., U.S.A. 06831-2559. Witco Corp. reports C400-C™ to be an amorphous form of overbased calcium petroleum sulfonate with the formula of: $(RC_6H_4SO_3)_2Ca+CaCO_3$.

Emersion-method Timken™ EP testing of low sulfur diesel containing the fuel additive shows the effect of the additive, as illustrated in Example 1:

Example 1. With the reservoir filled with untreated low sulfur diesel and the pressure set at 104 psi, the bearing seized up and smoked in 18 seconds. The fuel additive (comprising C400-C™) was then blended into the low sulfur diesel in the concentration of 1 fluid ounce additive/15 gallons diesel, the bearing and sacrifice roller were replaced, and the pressure was again set at 104 psi. The apparatus was then started and ran for 20 minutes at which time the apparatus was shut down because there was no seizure or other failure.

Example 2 illustrates the improvement of automobile performance and the residual benefit of the additive for engine restarts:

Example 2: A demonstration was done using an automobile with a turbo-diesel Mercedes engine. The preferred fuel additive of 40 vol-% C400-C™ Overbased Sulfonate, 10 vol-% jojoba oil, and 50 vol-% castor oil was added to the automobile's tank of low sulfur diesel in a concentration of 1 ounce additive/15 gallons diesel. The automobile was then driven in a mixture of city and highway driving. The automobile's mileage (miles/gallon) was calculated to be 20–25% higher with the additive in the diesel fuel. The automobile ran quieter and stronger, with better acceleration up hills without shifting. The tailpipe exhaust appeared smoke-free. Also, once the automobile had been started on the additive-containing fuel, subsequent re-starts of the engine were easier than normal.

As shown in Example 3, heavy equipment operation also improved with the addition of the fuel additive:

Example 3: The preferred fuel additive was added to the diesel fuel in a Caterpillar bulldozer in a concentration of 1 ounce/15 gal. diesel. The bulldozer then exhibited improved power, better restarting, smoke-free exhaust, and at least 10% improvement in gallon/hour fuel consumption.

As shown in Example 4, aircraft engine performance improved with the use of the fuel additive. Example 4 illustrates the results of an In-Flight Detonation Test, which is a known procedure following FAR Part 33 Required Test, which indicates the tendency for premature detonation of a fuel:

Example 4: A turbo-charged Continental 520 cu. in. engine in a Cessna Retractable Single-Engine aircraft was used for the In-Flight Detonation Test at the critical altitude of 19,000 feet. A comparison was made between two fuels: a) 100 octane aviation gasoline and b) 95 research octane premium unleaded Conoco gasoline, including the preferred fuel additive in a concentration of 1 ounce/15 gallons. The mixture was set at 28.8 gph aviation gasoline, at which there was no incipient detonation. Still using the aviation gasoline, the mixture was then leaned by 20% and incipient detonation was observed. The mixture was then reset at 28.8 gph fuel flow rate, and the fuel tanks were switched so that the airplane engine was being fed the premium unleaded automobile gasoline containing the fuel additive. After the switch to automobile gasoline+additive, the aircraft engine performed well and the fuel rate was leaned to 20% reduction without incipient detonation being observed. The fuel rate was then leaned to 25% reduction, also without incipient detonation being observed.

The in-flight detonation test of Example 4 suggests that the fuel additive may be added to premium unleaded gasoline to produce an excellent fuel for an aircraft engine, thus eliminating the need to have a separate aviation fuel source. This discovery can be extremely helpful in remote locations, developing countries, and isolated landing strips, where it can be very difficult to obtain aviation gasoline or to be assured of the quality of the aviation gasoline.

The invention is also not limited to the concentration of additive in the fuel that is recited in Examples 1–4. Other proportions and concentrations also result in surprising performance improvement. For example, the fuel additive has been tested down to concentrations of about 1 ounce additive/30 gallons fuel, at which the additive produces only small improvements in fuel performance. The fuel additive has been tested at concentrations up to about 1 ounce additive/5 gallons fuel, at which the additive shows performance that is slightly, but not significantly, better than the performance at 1 ounce additive/15 gallons fuel. It is believed that the high dosage of 1 ounce additive/5 gallons fuel may be beneficial for first-time use in a vehicle to quickly obtain the protection and residual effects of the additive, and thereafter that a dosage in the range of 1 ounce/10–20 gallons is adequate.

C400-C™ was found to be an excellent overbased sulfonate for formulation of the fuel additive, however, it is expected that other overbased sulfonates, both of amorphous and crystalline forms, will be found that produce fuel performance improvements.

In addition to the transportation fuel applications in Examples 1–4, the invented fuel additive is applicable to any internal combustion engine and the various fuels used therein. For example, the fuel additive may be added to aviation gas, gasoline, diesel fuel, and various blends and grades thereof. The fuel additive may be used for fuels for both mobile and stationary engines, for transportation, power generation, or other uses.

Lube Additive

The invented additive may also be added to motor-oil or other lube oils and, when in this service, is called "lube additive". The lube additive comprises a blend of RDSO15™ Overbased Sulfonate/jojoba oil/and castor oil in approximate proportions of 40 vol -%/10 vol-%/ 50 vol-%, respectively. The RDSO15™ Overbased Sulfonate is manufactured by Surpass Chemicals Limited and is marketed by Witco Corporation, whose addresses are listed above. Witco Corp. reports RDSO15™ to be a crystalline form of overbased sulfonate described as "modified metal alkyl aryl sulfonate".

Experimentation with the invented lube additive has shown surprising changes in lube oil lubrication performance, as shown in Example 5. As illustrated by tests such as Example 5, the lube additive appears to at least double a motor-oil's resistance to heat and pressure.

Example 5: Timken™ EP testing was done to demonstrate the relative lubrication performance of a motor-oil, Mobil 1™, with and without the lube additive. With Mobil 1™ surface-applied to the bearings and the pressure on the sacrifice bearing set at 234 psi, the apparatus ran for 3 minutes, 57 seconds before destruction. A lube additive of 40 vol-% RDSO15™ overbased sulfonate/10 vol-% jojoba oil/50 vol-% castor oil was then added to Mobil 1™ in a concentration of 10 vol-%, or about 1 part additive/9 parts Mobil 1™. With the Mobil 1™+additive surface-applied and the pressure set at 234 psi, the apparatus ran for 9 minutes before destruction of the sacrifice bearing.

The additive exhibits superior lubrication performance when applied to non-ferrous metals. This performance is remarkable, especially when compared to the little or no lubricating effect of many commercial lubes and lube additives when applied to non-ferrous metals. Example 6, below, illustrates these findings:

Example 6: A Timken™ apparatus was fitted with an aluminum sacrifice roller and a high carbon steel bearing. Buffered chlorinated paraffin, which was selected as the best lubricant in this test from a group of commercial lubes and additives, was applied by the surface application method. With the pressure set at 260 psi, the aluminum roller seized up after running for nine minutes. The test was repeated at 520 psi with the invented lube additive applied by surface application, and the test was shut down after about 1 hour when no seizing or other failure had occurred. The test was repeated at 520 psi with the invented lube additive and with a bronze sacrifice bearing, and the test was shut down after about 1 hour when no seizing or other failure had occurred.

These findings indicate that the invented additive will be valuable in the many engines that contain non-ferrous metals, for example, a steel cam-shaft running on an aluminum bearing surface.

The invention is not limited to the preferred concentration of additive in motor-oil of about 10 vol-%, or about 1 part additive/9 parts motor-oil. Other proportions and concentrations also result in surprising performance improvement. For example, the lube additive has been tested down to concentrations of about 5 vol-%, at which the additive produces some improvement in motor-oil lubrication performance, but much less than at a 10 vol-% concentration. Higher concentrations, such as 20 vol-%, produce even better performance than 10 vol-%. Therefore, concentrations in the range of 10–20 vol-% are preferred.

RDSO15™ was found to be an excellent overbased sulfonate for formulation of the lube additive, and C400-C™ produced results that were good but somewhat inferior to those of RDSO15™. It is expected that other overbased sulfonates, both of amorphous and crystalline forms, will be found that produce lubrication performance improvements.

Optionally, oil of wintergreen may be added to the lube additive to act as a viscosity controller, especially for cold weather applications.

The lube additive may be used in a variety of lube oils, or, in some instances, by itself. Applications include transportation and stationary internal combustion engines, machinery bearings, gears, gun-barrel lubricants, transmissions fluids, hydraulic oils and fluids, etc..

Additive Components

The jojoba oil used in the invented additive, both for fuel and lube services, is preferably the cold-pressed form that remains liquid down to about 40° F. However, the term "jojoba oil" may include other jojoba oil compounds that are derived or processed from jojoba (*Simmondsia chinensis, Simmondsia californica*).

The castor oil used in the invented additive, both for fuel and lube services, is preferably a food-grade variety, which may be produced, for example, by centrifugal processing rather than by extraction. However, the term "castor oil" may include other castor oil compounds that are derived or processed from the bean of the castor plant (*Ricinus communis*).

The invented additive preferably comprises non-toxic or low-toxicity components. C400-C™ Overbased Sulfonate is reported by its Material Safety Data Sheet (MSDS) to have "low order of toxicity and irritancy" and an Oral LD50 of "greater than 20 g/kg of body weight (rats)". According to its MSDS, RDSO15™ Overbased Sulfonate "may cause eye, nose and throat irritation and dizziness if used in unventilated areas . . . [or] with repeated contact". However, RDSP15™ is believed to be less toxic than many lube oil additives. The jojoba oil and castor oil are preferably food-grade or other non-toxic varieties of these oils. Therefore, the invented additives are believed to be safer for the environment and for humans and pets than past additives.

Although this invention has been described above with reference to particular means, materials and embodiments, it is to be understood that the invention is not limited to these disclosed particulars, but extends instead to all equivalents within the scope of the following claims.

I claim:

1. An additive consisting of overbased sulfonate, jojoba oil, and castor oil, in proportions of 20–50 vol-% overbased sulfonate, 1–20 vol-% jojoba oil, and 79 - 30 vol-% castor oil.

2. An additive as set forth in claim 1, wherein the overbased sulfonate comprises an amorphous alkaline-earth form of overbased sulfonate.

3. An additive as set forth in claim 1, wherein the overbased sulfonate comprises a crystalline alkaline-earth form of overbased sulfonate.

4. An additive as set forth in claim 1, wherein the overbased sulfonate, jojoba oil, and castor oil are in the volume percentages of about 40/10/50, respectively.

5. An additive as set forth in claim 1, wherein the overbased sulfonate is an amorphous form of overbased calcium petroleum sulfonate with a formula of $(RC_6H_4SO_3)_2Ca+CaCO_3$.

6. A composition of matter comprising a lube oil and an additive consisting Of an overbased sulfonate, jojoba oil, and castor oil in proportions of 20–50 vol-% overbased sulfonate, 1–20 vol-% jojoba oil, and 79 - 30 vol-% castor oil.

7. A composition of matter as set forth in claim 6, wherein the overbased sulfonate comprises an amorphous alkaline-earth form of overbased sulfonate.

8. A composition of matter as set forth in claim 6, wherein the overbased sulfonate comprises a crystalline alkaline-earth form of overbased sulfonate.

9. A composition of matter as set forth in claim 6, wherein the overbased sulfonate, jojoba oil, and castor oil are in the volume percentages of about 40/10/50, respectively.

10. A composition of matter as set forth in claim 6, wherein the overbased sulfonate is an amorphous form of overbased calcium petroleum sulfonate with a formula Of $(RC_6H_4SO_3)_2Ca+CaCO_3$.

11. A composition of matter as set forth in claim 6, wherein the additive and the lube oil are in the volume proportions of about 1 part additive/9 parts lube oil.

* * * * *